US011268752B2

(12) United States Patent
Ohta et al.

(10) Patent No.: US 11,268,752 B2
(45) Date of Patent: Mar. 8, 2022

(54) REFRIGERATION DEVICE

(71) Applicant: PHC HOLDINGS CORPORATION, Tokyo (JP)

(72) Inventors: Akihiro Ohta, Saitama (JP); Takashi Kawakami, Saitama (JP); Yorio Takahashi, Ehime (JP); Hiroyuki Sato, Saitama (JP)

(73) Assignee: PHC HOLDINGS CORPORATION, Tokyo (JP)

( * ) Notice: Subject to any disclaimer, the term of this patent is extended or adjusted under 35 U.S.C. 154(b) by 294 days.

(21) Appl. No.: 16/727,796

(22) Filed: Dec. 26, 2019

(65) Prior Publication Data

US 2020/0132365 A1 Apr. 30, 2020

Related U.S. Application Data

(63) Continuation of application No. PCT/JP2018/019116, filed on May 17, 2018.

(30) Foreign Application Priority Data

Jul. 5, 2017 (JP) ..... JP2017-132136

(51) Int. Cl.
*F25D 29/00* (2006.01)
*F25D 11/00* (2006.01)

(52) U.S. Cl.
CPC ..... *F25D 29/006* (2013.01); *F25D 11/006* (2013.01); *F25D 2600/00* (2013.01)

(58) Field of Classification Search
CPC .. F25D 29/006; F25D 11/006; F25D 2600/00; F25D 29/001; F25B 9/145; F25B 2700/21
See application file for complete search history.

(56) References Cited

U.S. PATENT DOCUMENTS 5,284,022 A * 2/1994 Chung ..... F25B 9/14 62/6
6,698,210 B2 * 3/2004 Ogura ..... F25B 9/14 62/457.9

(Continued)

FOREIGN PATENT DOCUMENTS

CN 10465651 * 5/2015 ..... F25B 2700/2103
GB 2514622 A * 12/2014 ..... F25D 11/006

(Continued)

OTHER PUBLICATIONS

English Translation of KR930000943 (Year: 1993).*

(Continued)

*Primary Examiner* — David J Teitelbaum
(74) *Attorney, Agent, or Firm* — McDermott Will & Emery LLP

(57) ABSTRACT

A refrigeration device includes: a refrigerator; a heat pipe that includes a condensation unit connected to the refrigerator and adapted to condense a refrigerant, includes an evaporation unit connected to a storage chamber and adapted to evaporate the refrigerant, and includes a piping for circulating the refrigerant between the condensation unit and the evaporation unit; a heat pipe temperature sensor that detects a temperature of the heat pipe; and a control unit that controls driving of the refrigerator based on a result of detection by the heat pipe temperature sensor. The control unit controls the refrigerator so that the temperature of the heat pipe does not fall below a standard boiling temperature of the refrigerant.

8 Claims, 8 Drawing Sheets

1(1A)

(56) References Cited

U.S. PATENT DOCUMENTS

| | | | | |
|---|---|---|---|---|
| 7,386,984 | B2 * | 6/2008 | Zhang | F25B 25/00 62/333 |
| 2005/0172644 | A1 * | 8/2005 | Zhang | F25B 25/005 62/6 |

FOREIGN PATENT DOCUMENTS

| | | | | |
|---|---|---|---|---|
| JP | H8-320165 | A | 12/1996 | |
| KR | 930000943 | B1 * | 2/1993 | F25D 11/00 |

OTHER PUBLICATIONS

English Translation of CN 10465651 (Year: 2015).*
GB 2514622 Translation (Year: 2013).*
International Search Report issued in corresponding International Patent Application No. PCT/JP2018/019116, dated Aug. 14, 2018, with English translation.

* cited by examiner

REFRIGERATION DEVICE

CROSS-REFERENCE TO RELATED APPLICATIONS

This application is a U.S. continuation application of International Patent Application No. PCT/JP2018/019116, filed on May 17, 2018, which claims the benefit of priority of Japanese Patent Application No. 2017-132136, filed on Jul. 5, 2017, the entire content of each of which is incorporated herein by reference.

BACKGROUND

Field of the Invention

The present invention relates to refrigeration devices, and, more particularly, to a refrigeration device adapted to condense a refrigerant and then exhibit a cooling action by evaporating the refrigerant.

Description of the Related Art

Refrigeration devices configured to exchange heat between a refrigerator and a low-temperature storage chamber via a heat pipe connected to the cooling unit of the refrigerator are known (see, for example, patent literature 1). In the refrigeration device disclosed in patent literature 1, a gas entrapment for adjusting the pressure inside the heat pipe is provided.

[Patent literature 1] JP8-320165

A heat pipe is a structure to transfer heat by using liquification of an entrapped refrigerant. Therefore, the internal pressure of the heat pipe is increased significantly while the heat is not being transferred, i.e., while the refrigeration device is being stopped than while the heat is being transferred, i.e., while the refrigeration device is being in operation. If ambient air enters the heat pipe during the operation of the refrigeration device, therefore, the internal pressure of the heat pipe will be excessive when the refrigeration device is stopped, with the result that the heat pipe might be damaged or broken. In a refrigeration device provided with a heat pipe, therefore, it is desired to inhibit entry of ambient air into the heat pipe. We have studied refrigeration devices provided with a heat pipe extensively and have recognized that there is room for improvement in related-art refrigeration devices in regard to inhibition of entry of ambient air into the heat pipe.

SUMMARY OF THE INVENTION

The present disclosure addresses the above-described issue, and an illustrative purpose thereof is to provide a technology for inhibiting entry of ambient air into a heat pipe.

An embodiment of the present embodiment relates to a refrigeration device. The refrigeration device includes: a refrigerator; a heat pipe that includes a condensation unit connected to the refrigerator in a manner that heat exchange is enabled and adapted to condense a refrigerant, includes an evaporation unit connected to a storage chamber for housing an object that should be stored in a manner that heat exchange is enabled and adapted to evaporate the refrigerant, and includes a piping for circulating the refrigerant between the condensation unit and the evaporation unit; a heat pipe temperature sensor that detects a temperature of the heat pipe; and a control unit that controls driving of the refrigerator based on a result of detection by the heat pipe temperature sensor. The control unit controls the refrigerator so that the temperature of the heat pipe does not fall below a standard boiling temperature of the refrigerant.

BRIEF DESCRIPTION OF THE DRAWINGS

Embodiments will now be described, by way of example only, with reference to the accompanying drawings which are meant to be exemplary, not limiting, and wherein like elements are numbered alike in several Figures, in which.

DETAILED DESCRIPTION OF THE INVENTION

Figure 1:
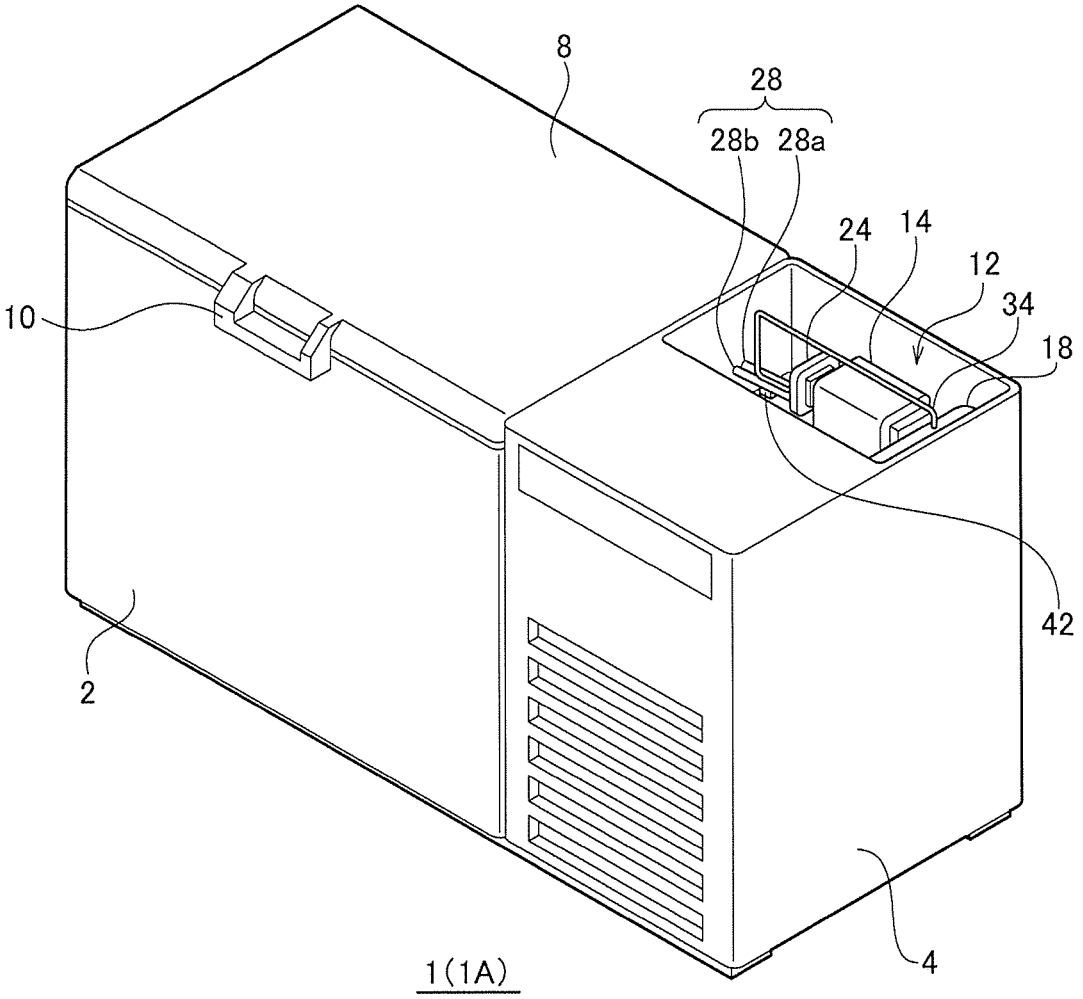
FIG. 1 is a perspective view showing a schematic structure of a low-temperature storage in which the refrigeration device according to embodiment 1 is installed.

The invention will now be described by reference to the preferred embodiments. This does not intend to limit the scope of the present invention, but to exemplify the invention.

Hereinafter, the invention will be described based on preferred embodiments with reference to the accompanying drawings. The preferred embodiments do not intend to limit the scope of the invention but exemplify the invention. Not all of the features and the combinations thereof described in the embodiments are necessarily essential to the invention. Identical or like constituting elements, members, processes shown in the drawings are represented by identical symbols and a duplicate description will be omitted. The scales and shapes of the respective parts shown in the figures are defined for convenience's sake to make the explanation easy and shall not be interpreted limitatively unless otherwise specified. Terms like "first", "second", etc. used in the specification and claims do not indicate a sequence or degree or importance by any means unless otherwise specified and are used to distinguish a certain feature from the others.

Embodiment 1

Figure 2:
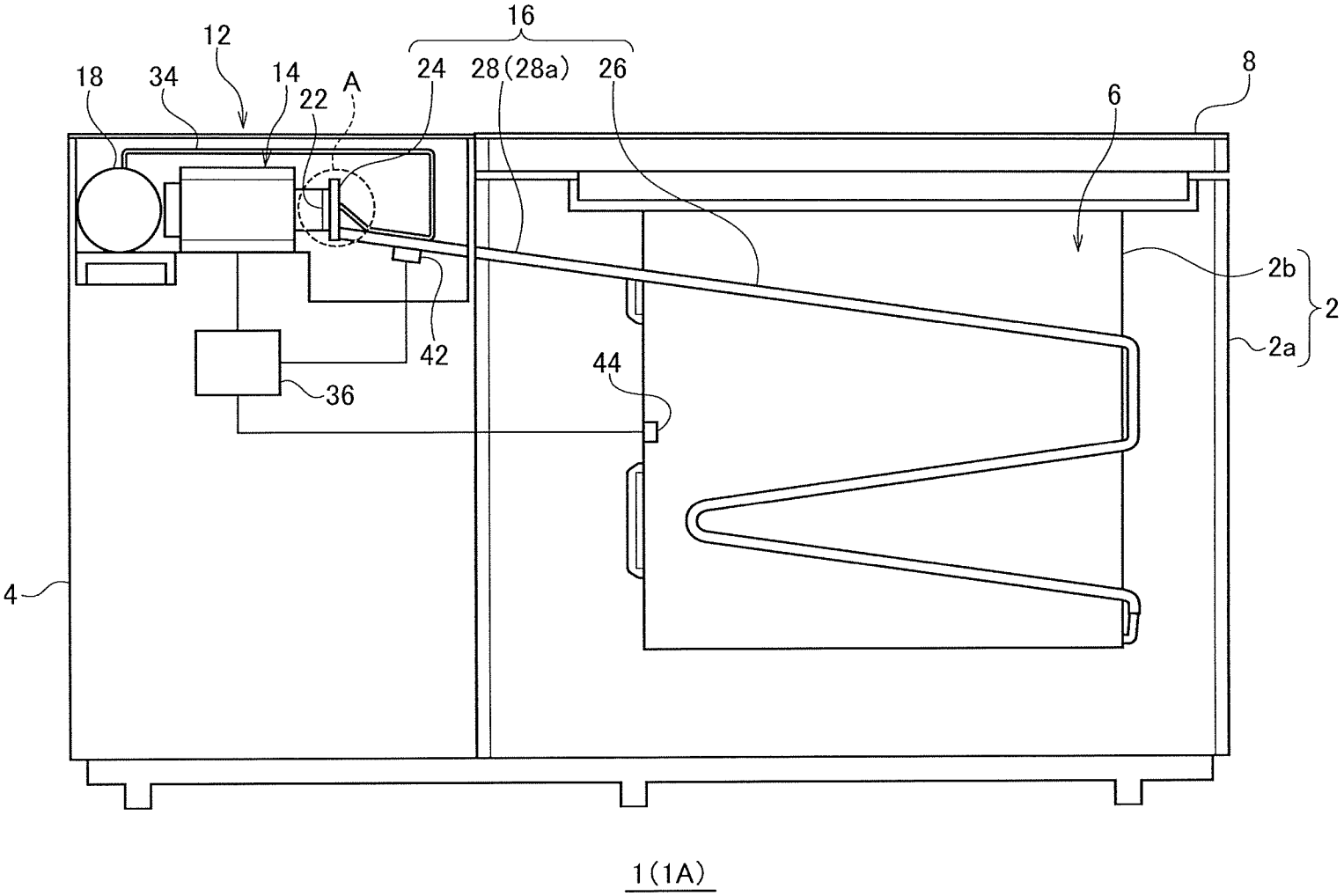
FIG. 2 is a rear view showing a schematic structure of the low-temperature storage.
Figure 3:
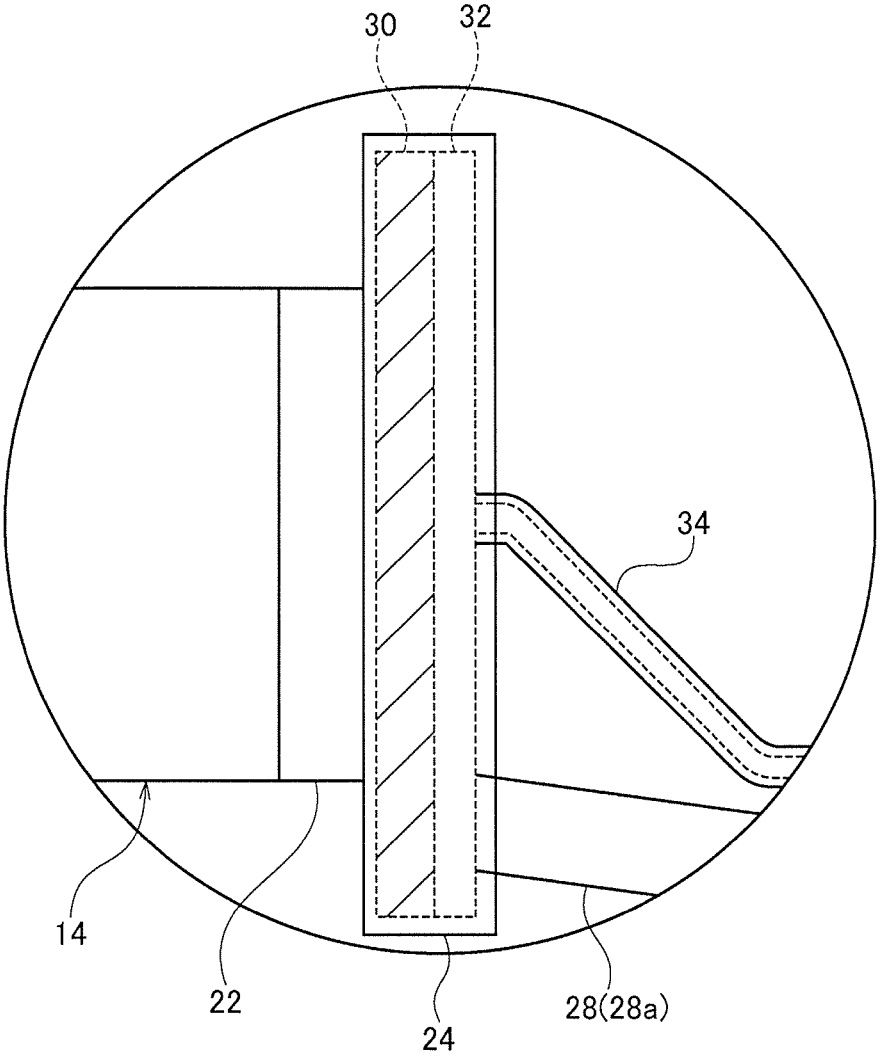
FIG. 3 is an enlarged view of area A bounded by the broken line in FIG. 2.

FIG. 1 is a perspective view showing a schematic structure of a low-temperature storage in which the refrigeration device according to embodiment 1 is installed. FIG. 2 is a rear view showing a schematic structure of the low-temperature storage. FIG. 3 is an enlarged view of area A bounded by the broken line in FIG. 2. FIG. 2 is a transparent view of the interior of the low-temperature storage. A low-temperature storage 1 (1A) is used to store a biological material such as a cell and a tissue of a living body, a medication, a reagent, etc. at a low temperature. The low-temperature storage 1 includes a heat insulation box body 2 with an open top and a machine room 4 provided adjacent to the heat insulation box body 2.

The heat insulation box body 2 includes an outer box 2*a* with an open top and an inner box 2*b* with an open top. The space between the outer box 2*a* and the inner box 2*b* is filled with a heat insulator (not shown). The heat insulator is made from, for example, a polyurethane resin, a glass wool, and a vacuum heat insulator. The space in the inner box 2*b* defines a storage chamber 6. The storage chamber 6 is a space in which an object that should be stored is housed. The targeted temperature inside the storage chamber 6 (hereinafter, referred to as inside temperature as appropriate) is, for example, −50° C. or below. An inside temperature sensor 44 is provided at a predetermined position in the storage chamber 6. The inside temperature sensor 44 senses the inside temperature, generates a detection value based on the sensed temperature, and outputs the detection value to a control unit 36 described later.

A heat insulation door 8 is provided on the top surface of the heat insulation box body 2 via a packing. A heat insulation door 8 is fixed at one end to the heat insulation box body 2 and is provided to be rotatable around the one end. This heat insulation door 8 ensures that the opening of the storage chamber 6 can be opened or closed as desired. The other end of the heat insulation door 8 is provided with a handle 10 maneuvered to open or close the heat insulation door 8. An evaporation unit 26 of a heat pipe 16 described later is provided on the wall surface of the inner box 2*b* toward the heat insulator. The interior of the storage chamber 6 is cooled due to evaporation of the refrigerant in the evaporation unit 26.

The machine room 4 is a space that houses a refrigeration device 12 according to the embodiment except that a part of a piping 28 of the heat pipe 16 and the evaporation unit 26 are provided in the heat insulation box body 2. The machine room 4 is spaced apart from the storage chamber 6. A cooling unit 22 of the refrigerator 14, a condensation unit 24 of the heat pipe 16, and a part of a piping 28, which are provided in the machine room 4, are covered by a heat insulator (not shown) and are thermally insulated from the environment. The heat insulator is made from, for example, a urethane resin, a glass wool, and a heat insulating rubber. The structure of the heat insulation box body 2 and the machine room 4 is publicly known so that a description of further details is omitted.

The refrigeration device 12 is a device capable of cooling the interior of the storage chamber 6 to an extremely low temperature of −50° C. or below. The refrigeration device 12 includes a refrigerator 14, the heat pipe 16, a refrigerant chamber 18, a heat pipe temperature sensor 42, and a control unit 36.

The refrigerator 14 is a device for cooling the condensation unit of the heat pipe 16. The refrigerator 14 is provided in the machine room 4. A publicly known refrigerator such as a Gifford-McMahon (GM) refrigerator, a pulse tube refrigerator, a Stirling refrigerator, a Solvay refrigerator, a Claude cycle refrigerator, and a Joule Thomson refrigerator can be used as the refrigerator 14. The refrigerator 14 includes a cooling unit 22 adapted to absorb the external heat. The structure of the refrigerator 14 is publicly known so that a description of further details is omitted.

The heat pipe 16 is a device for cooling a target of cooling by using the vaporization heat of the refrigerant and mediates heat exchange between the cooling unit 22 of the refrigerator 14 and the interior of the storage chamber 6. The heat pipe 16 includes a condensation unit 24, an evaporation unit 26, and a piping 28. The condensation unit 24 is connected to the cooling unit 22 of the refrigerator 14 in a manner that heat exchange is enabled. By causing the condensation unit 24 and the cooling unit 22 to exchange heat, the refrigerant in the condensation unit 24 is cooled, condensed, and turned into a liquid. For example, a refrigerant gas such as R740 (argon), R50 (methane), R14 (tetrafluoromethane), and R170 (ethane) can be used as the refrigerant. A refrigerant, which has a standard boiling temperature lower than the minimum value of the target temperature of the storage chamber 6 that can be set in the refrigerator 14, is selected. This can be understood from the fact that the storage chamber 6 is cooled by the heat pipe 16 and so cannot be at a temperature equal to or lower than the boiling temperature of the refrigerant unless the ambient temperature is an extremely low temperature. The standard boiling temperature of a refrigerant is a boiling temperature at the atmospheric pressure (1 atm=101325 Pa). A value determined from a documented value or a publicly known vapor-liquid equilibrium curve data can be employed as the standard boiling temperature.

More specifically, the condensation unit 24 includes, as shown in FIG. 3, a condensation fin 30 and a refrigerant passage 32 formed by the grooves of the condensation fin 30. The condensation fin 30 is connected to the cooling unit 22. The cold of the cooling unit 22 is transferred to the refrigerant flowing in the refrigerant passage 32 via the condensation fin 30. The refrigerant in a gasified state is turned into a liquid in the refrigerant passage 32.

One end of the piping 28 is connected to the condensation unit 24. More specifically, one end of the piping 28 is connected to the refrigerant passage 32. Further, the other end of the piping 28 is connected to the evaporation unit 26. The refrigerant is circulated between the condensation unit 24 and the evaporation unit 26 via the piping 28.

The evaporation unit 26 is connected to the storage chamber 6 in a manner that heat exchange is enabled. In this embodiment, the evaporation unit 26 extends along the wall surface of the inner box 2*b* toward the heat insulator. The refrigerant turned into a liquid in the condensation unit 24 flows into the evaporation unit 26 via the piping 28. In the evaporation unit 26, the refrigerant absorbs the heat from the storage chamber 6 and is evaporated. Evaporation of the refrigerant cools the interior of the storage chamber 6. The refrigerant turned into a gas in the evaporation unit 26 flows into the refrigerant passage 32 of the condensation unit 24 via the piping 28. The refrigerant is condensed again and turned into a liquid in the condensation unit 24.

The condensation unit 24 is provided vertically above the evaporation unit 26. Therefore, the refrigerant turned into a liquid in the condensation unit 24 is gravitationally transferred to the evaporation unit 26. In other words, the heat pipe 16 according to the embodiment is a so-called thermosiphon that circulates the refrigerant gravitationally.

As shown in FIG. 1, the piping 28 according to the embodiment includes a far-side connecting pipe 28*a* and a near-side connecting pipe 28*b*. One end of the far-side connecting pipe 28*a* and one end of the near-side connecting pipe 28*b* are connected to the refrigerant passage 32. Further, the evaporation unit 26 has a pipe shape, and the other end of the far-side connecting pipe 28*a* is connected to one end of the evaporation unit 26. The other end of the evaporation unit 26 is connected to the other end of the near-side connecting pipe 28*b*.

A portion of the refrigerant flows from the refrigerant passage 32 into the evaporation unit 26 via the far-side connecting pipe 28*a*. The refrigerant mainly cools the far side of the inner box 2*b* (rear side of the storage chamber 6) before it reaches the lower end of the evaporation unit 26. The refrigerant evaporated and turned into a gas in this process returns to the refrigerant passage 32 via the far-side connecting pipe 28*a*. In other words, the liquefied refrigerant and the gasified refrigerant flow in the opposite directions in the evaporation unit 26 and the far-side connecting pipe 28*a*. In this process, the liquid refrigerant flows near the circumference of the piping, and the gas refrigerant flows near the center of the piping.

Further, another portion of the refrigerant flows from the refrigerant passage 32 into the evaporation unit 26 via the near-side connecting pipe 28*b*. The refrigerant mainly cools the near side of the inner box 2*b* (front side of the storage chamber 6) before it reaches the lower end of the evaporation unit 26. The refrigerant evaporated and turned into a gas in this process returns to the refrigerant passage 32 via the near-side connecting pipe 28*b*. In other words, the liquefied refrigerant and the gasified refrigerant flow in the opposite directions in the evaporation unit 26 and the near-side connecting pipe 28*b*. In this process, the liquid refrigerant flows near the circumference of the piping, and the gas refrigerant flows near the center of the piping.

In other words, a refrigerant circulation path of the first system including the far-side connecting pipe 28*a* and a refrigerant circulation path of the second system including the near-side connecting pipe 28*b* are formed between the refrigerant passage 32 and the lower end of the evaporation unit 26.

Further, the heat pipe 16 according to the embodiment is structured to circulate the refrigerant gravitationally so that the piping 28 is inclined with respect to the horizontal plane. Most of the liquid refrigerant flowing in the pipe flows in the lower half of the pipe in the vertical direction. For the purpose of circulating the refrigerant smoothly, the larger than the angle of inclination of the pipe, the better. Meanwhile, a large angle of inclination of the pipe results in a larger height of the low-temperature storage 1. As a result, the workability experienced when housing the object that should be stored in the storage chamber 6 is lowered. For this reason, the angle of inclination of the pipe is preferably about 10 degree.

The heat pipe 16 may be structured to circulate the refrigerant by a capillary force. In this case, the far-side connecting pipe 28*a* is defined as an outward path unit, and the near-side connecting pipe 28*b* is defined as a return path unit. A circulation path of refrigerant connecting the refrigerant passage 32, the outward path unit, the evaporation unit 26, and the return path unit in this sequence is formed.

The refrigerant chamber 18 is a storage tank connected to the heat pipe 16 to pool the refrigerant of the heat pipe 16. The refrigerant chamber 18 is connected to the refrigerant passage 32 of the condensation unit 24 via a pipe 34. The refrigerant can go back and forth between the heat pipe 16 and the refrigerant chamber 18 via the pipe 34. When the pressure in the heat pipe 16 is increased, a portion of the refrigerant moves from the heat pipe 16 to the refrigerant chamber 18. When the pressure in the heat pipe 16 is decreased, a portion of the refrigerant moves from the refrigerant chamber 18 to the heat pipe 16. In this way, the pressure in the heat pipe 16 is adjusted. This internal pressure of the heat pipe 16 is set to be equal to or higher than the atmospheric pressure.

The heat pipe temperature sensor 42 detects the temperature of the heat pipe 16. The heat pipe temperature sensor 42 can substantially measure the temperature of the refrigerant. In this embodiment, the heat pipe temperature sensor 42 is provided on the lateral surface of the piping 28 and detects the temperature of the piping 28 (hereinafter, referred to as piping temperature as appropriate). The piping 28 is less affected by the temperature in the storage chamber 6 than the evaporation unit 26. Further, the piping 28 is less affected by the temperature of the cooling unit 22 than the condensation unit 24. Thus, the temperature of the refrigerant can be measured more accurately than otherwise by detecting the temperature of the piping 28.

Preferably, the heat pipe temperature sensor 42 detects the temperature in a portion of the piping 28 extending in the machine room 4. More preferably, the heat pipe temperature sensor 42 detects the temperature at the center of the portion of the piping 28 extending in the machine room 4. The center is a region including the middle point equally distanced from the ends of the portion extending in the machine room 4. Temperature detection by the heat pipe temperature sensor 42 is easily affected by a localized inflow of heat. Meanwhile, the piping 28 extends from the heat insulation box body 2 to the machine room 4. At the boundary of the machine room 4 with the heat insulation box body 2, localized inflow of heat by way of the boundary could occur. Therefore, the end of the portion of the piping 28 extending in the machine room 4 toward the heat insulation box body 2 is easily affected by the localized inflow of heat. Thus, the temperature of the refrigerant can be measured more accurately than otherwise by causing the heat pipe temperature sensor 42 to detect the temperature at the center of the portion of the piping 28 extending in the machine room 4. Further, it is preferred that the heat pipe temperature sensor 42 be provided in a region on the lateral surface of the piping 28 that faces downward in the vertical direction. This is because the liquefied refrigerant flows on the lower side of the piping 28 in the vertical direction.

The heat pipe temperature sensor 42 and the inside temperature sensor 44 are sensors such as a thermoelectric couple and a resistance temperature detector in which the electrical characteristics vary depending on the temperature. A thermoelectric couple outputs a thermal electromotive force, which is commensurate with a temperature difference between the temperature at a reference junction and the temperature at a temperature measuring junction, to the temperature measuring junction in the form of a voltage. The temperature value corresponding to the voltage value is identified. The resistance temperature detector is exemplified by a platinum thin film resistance temperature detector. The platinum thin film resistance temperature detector is exemplified by PT100, which has a resistance value of 100Ω at 0° C., PT1000, which has a resistance value of 1000 Ω at 0° C., etc. These detectors are defined domestically in JISC1604. These resistance temperature detectors measure the resistance value that varies depending on the temperature of the temperature measuring junction. The resistance temperature detectors convert the resistance value into a temperature value in accordance with a predetermined conversion formula or a conversion table and outputs the temperature value. The temperature sensors output the temperature value to the control unit 36. The temperature information transmitted to the control unit 36 may not be a direct temperature value but may be a voltage value, a current value, a resistance value, etc. commensurate with the the temperature value. Hereinafter, these will be generically referred to as detection values. In performing control, however, it should be considered that the variation in the voltage value, etc. with respect to the temperature value may not be linear depending on the type of sensor used. A publicly known sensor may be used as the heat pipe temperature sensor 42 and the inside temperature sensor 44. The heat pipe temperature sensor 42 and the inside temperature sensor 44 may not be of the same type so long as the detection value is ultimately output on the same scale.

The control unit 36 controls the driving of the refrigerator 14 based on the result of detection by the heat pipe temperature sensor 42. The control unit 36 controls the refrigerator 14 so that the temperature of the heat pipe 16 does not fall below the standard boiling temperature of the refrigerant. The control unit 36 is implemented in hardware such as a device or a circuit exemplified by an amplifier, a digital signal processor, a CPU and a memory of a computer, etc. The control unit 36 is also implemented by a loop control circuit or control software such as a computer program. It will be understood by those skilled in the art that the control unit 36 may be implemented in a variety of manners by a combination of hardware and software.

Figure 4:
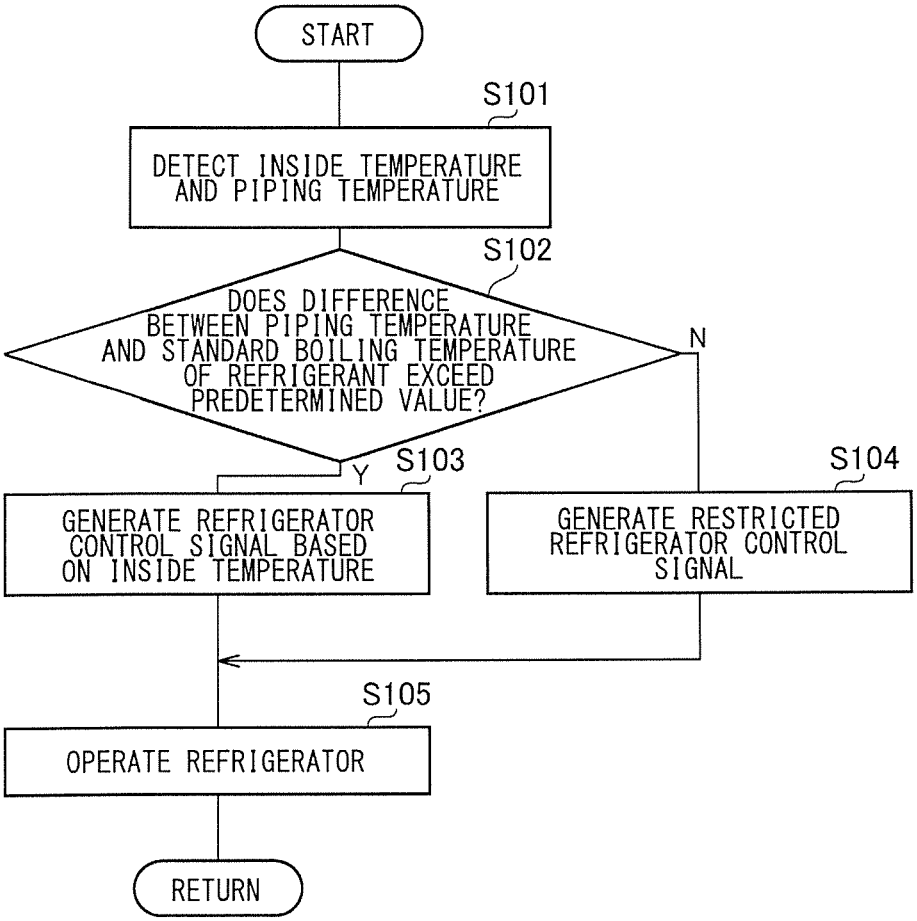
FIG. 4 is a flowchart showing an example of control performed in the refrigeration device according to the embodiment 1.

A description will now be given of control performed by the control unit 36 according to the embodiment. FIG. 4 is a flowchart showing an example of control performed in the refrigeration device according to embodiment 1. The refrigeration device 12 is operated as the control unit 36 performs the flow repeatedly according to a predetermined timing schedule.

The control unit 36 according to the embodiment generates a signal for controlling the driving of the refrigerator 14 based on the result of detection by the inside temperature sensor 44 in addition to the result of detection by the heat pipe temperature sensor 42. More specifically, the temperature of the piping and the inside temperature are first detected by the heat pipe temperature sensor 42 and the inside temperature sensor 44, as shown in FIG. 4 (S101). The control unit 36 acquires the detection value commensurate with the pipe temperature from the heat pipe temperature sensor 42 and acquires the detection value commensurate with the inside temperature from the inside temperature sensor 44. A determination is then made as to whether the difference between the piping temperature and the standard boiling temperature of the refrigerant exceeds a predetermined value (S102). This makes it possible to determine whether the temperature of the piping 28 falls below the standard boiling temperature of the refrigerant, i.e., whether the temperature of the refrigerant falls below the standard boiling temperature. The predetermined value can be set as appropriate based on an experiment by the designer or simulation.

When the difference between the piping temperature and the standard boiling temperature of the refrigerant exceeds the predetermined value (Y in S102), a control signal for controlling the refrigerator 14 based on the inside temperature is generated (S103). Specifically, the control unit 36 adjusts the output of the refrigerator 14 based on the result of detection by the inside temperature sensor 44 and, specifically, the signal based on the detection value acquired from the inside temperature sensor 44, so that the inside temperature is within a predetermined range with respect to a predetermined target temperature. For example, the control unit 36 detects a difference between the target temperature and the current inside temperature and adjusts the output of the refrigerator 14 based on the difference. The target temperature is set by, for example, the user of the low-temperature storage 1. The predetermined range can be set as appropriate based on an experiment by the designer or simulation.

An ordinary, publicly known method of adjustment can be used to adjust the output of the refrigerator 14. Such output adjustment is exemplified by simple on/off control whereby the output is stopped when the difference between the target temperature and the current inside temperature resides within a predetermined range, and the output is resumed when the difference exceeds the predetermined range. In the case an inverter circuit etc. is provided as an output adjustment circuit and the output of the refrigerator 14 can be changed continuously, the output value may be adjusted continuously by so-called PID control. This enables more stable temperature control.

When the difference between the piping temperature and the standard boiling temperature of the refrigerant is equal to or smaller than the predetermined value (N in S102), a restricted control signal for the refrigerator 14 is generated (S104). In other words, the output of the refrigerator 14 is restricted irrespective of the result of detection by the inside temperature sensor 44. The control unit 36 generates a signal for controlling the refrigerator 14 based on the detection value acquired from the heat pipe temperature sensor 42, so that the piping temperature does not fall below the standard boiling temperature of the refrigerant. This control is performed in preference to control of the inside temperature. The predetermined value can be set as appropriate based on an experiment by the designer or simulation.

For example, the control unit 36 stores the standard boiling temperature of the refrigerant filling the heat pipe 16. The control unit 36 restricts the refrigerator 14 when the difference between the current detection value of the heat pipe temperature sensor 42 and the detection value (the value is stored in the control unit 36 in advance) output by the heat pipe temperature sensor 42 when the piping temperature is the standard boiling temperature of the refrigerant is equal to or smaller than the predetermined value. By way of one example, the control unit 36 stops driving the refrigerator 14 when the difference between the piping temperature and the standard boiling temperature of the refrigerator is equal to or smaller than the predetermined value. By way of another example, in the case an inverter circuit, etc. is provided as an output adjustment circuit and the output of the refrigerator 14 can be changed continuously, the output of the refrigerator 14 may be restricted so that the piping temperature does not fall below the standard boiling temperature of the refrigerator, while the refrigerator 14 is driven continuously.

The control signal for controlling the refrigerator 14 generated in step S103 or step S104 is output to the refrigerator 14, and the refrigerator 14 is driven with the output value as set (S105). When, as a result of restricting the output of the refrigerator 14 in this route, the piping temperature is increased, and the difference between the piping temperature and the standard boiling temperature of the refrigerant exceeds the predetermined value in the subsequent routines (Y in S102), control of the refrigerator 14 based on the result of detection by the inside temperature sensor 44 is resumed (S103).

As described above, the refrigeration device 12 according to the embodiment is provided with the refrigerator 14, the heat pipe 16, the heat pipe temperature sensor 42, and the control unit 36. The heat pipe temperature sensor 42 detects the temperature of the heat pipe 16. The control unit 36 controls the driving of the refrigerator 14 based on the result of detection by the heat pipe temperature sensor 42 so that the temperature of the heat pipe 16 does not fall below the standard boiling temperature of the refrigerant, i.e., is equal to or higher than the standard boiling temperature. When the temperature of the heat pipe 16 falls below the standard boiling temperature of the refrigerant, liquification of the refrigerant advances to shift the vapor-liquid equilibrium state, with the result that the internal pressure of the heat pipe 16 might be less than the atmospheric pressure. This is addressed by controlling the driving of the refrigerator 14 so that the temperature of the heat pipe 16 is equal to or higher than the standard boiling temperature of the refrigerant, thereby preventing the internal pressure of the heat pipe 16 from becoming less than the atmospheric pressure. In other words, it is guaranteed that the refrigerant in the heat pipe 16 is in the vapor-liquid equilibrium at a pressure equal to or higher than the atmospheric pressure, provided that the temperature of the heat pipe 16 is equal to or higher than the standard boiling temperature of the refrigerator. As a result, entry of ambient air into the heat pipe 16 is inhibited.

When it is possible to inhibit entry of ambient air into the heat pipe 16, the internal pressure of the heat pipe 16 is prevented from being increased excessively even if the refrigerator 14 is stopped and the temperature of the refrigerant is increased. Accordingly, the heat pipe 16 is prevented from being damaged or broken. Also, corrosion of the heat pipe 16 due to entry of ambient air is avoided. It is conceivable to monitor the internal pressure of the heat pipe 16 by a pressure sensor to prevent damage to the heat pipe 16. However, the cost of employing the heat pipe temperature sensor 42 is lower than the cost of employing a pressure sensor.

The heat pipe temperature sensor 42 according to the embodiment detects the temperature of the piping 28 of the heat pipe 16 that connects the condensation unit 24 and the evaporation unit 26. This makes it possible to understand the temperature of the refrigerant in the vapor-liquid equilibrium state (vapor-liquid equilibrium temperature) more accurately. By detecting the temperature of the portion of the piping 28 extending in the machine room 4 and, more particularly, the temperature at the center of the portion, the vapor-liquid equilibrium temperature is known more accurately. Accordingly, the internal pressure of the heat pipe 16 is prevented from becoming less than atmospheric pressure more properly, by controlling the driving of the refrigerator 14 so that the temperature at the portion does not fall below the standard boiling temperature of the refrigerant.

The relationship between the temperature and the internal pressure of the heat pipe 16, internal pressure adjustment of the heat pipe 16 performed by controlling the driving of the refrigerator 14, and the relationship between the designed inside temperature and the standard boiling temperature of the refrigerant described above are discovered through our study.

Embodiment 2

The refrigeration device according to embodiment 2 differs significantly from the refrigeration device according to embodiment 1 in respect of the detail of control by the control unit 36. A description of the refrigeration device according to embodiment 2 will be given below, highlighting the feature different from that of embodiment 1. Common features are described briefly, or a description thereof is omitted.

As in embodiment 1, the refrigeration device 12 according to embodiment 2 includes the refrigerator 14, the heat pipe 16, the heat pipe temperature sensor 42, the inside temperature sensor 44, and the control unit 36. The control unit 36 controls the refrigerator 14 so that the temperature of the heat pipe 16 does not fall below the standard boiling temperature of the refrigerant.

Figure 5:
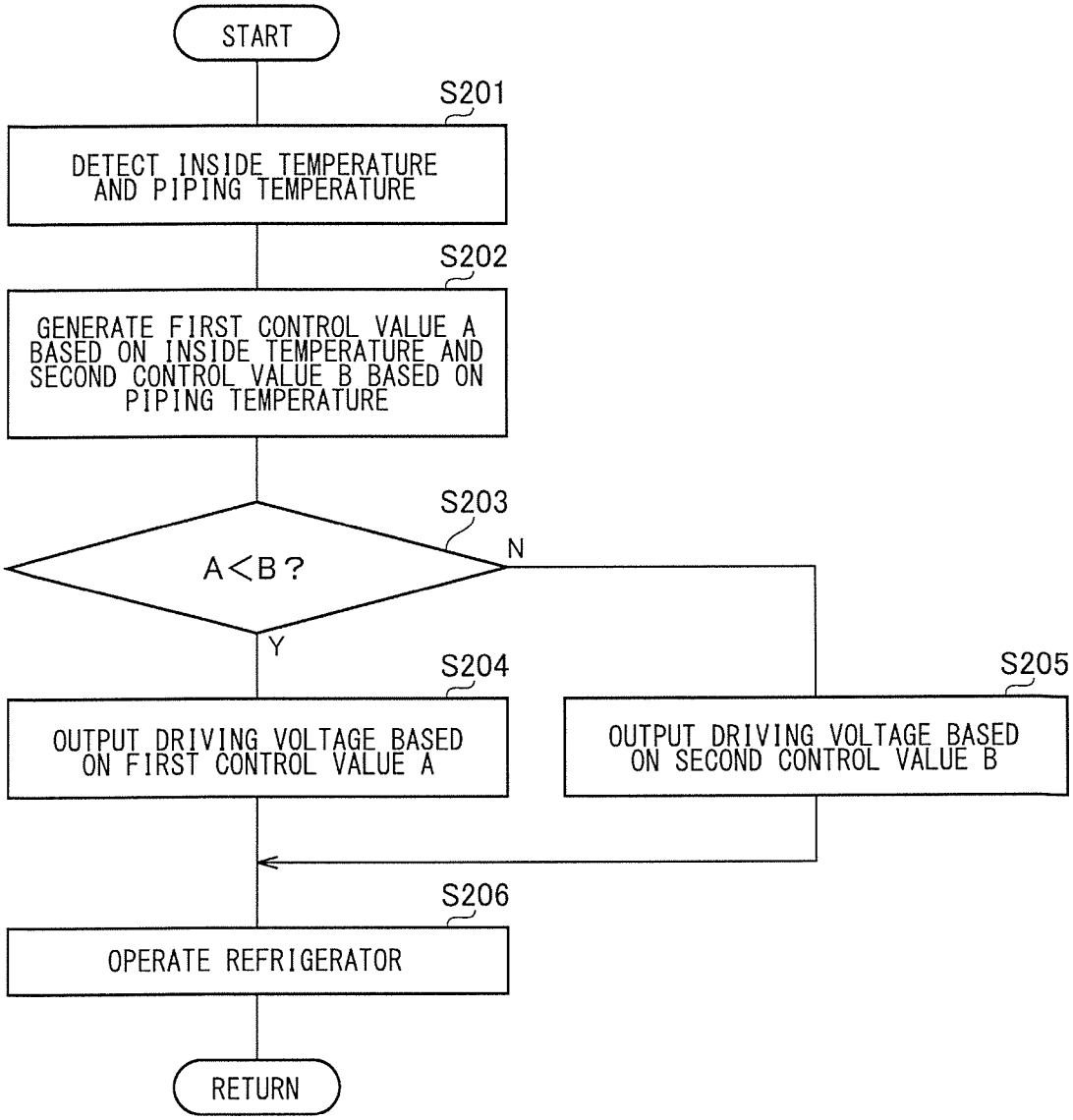
FIG. 5 is a flowchart showing an example of control performed by the refrigeration device according to embodiment 2.

Further, the control unit 36 according to this embodiment controls the driving of the refrigerator 14 based on the result of detection by the heat pipe temperature sensor 42 and the inside temperature sensor 44, as shown in FIG. 5. FIG. 5 is a flowchart showing an example of control performed by the refrigeration device according to embodiment 2. The flow is is performed by the control unit 36 repeatedly according to a predetermined timing schedule.

As shown in FIG. 5, the inside temperature and the piping temperature are detected first (S201). The control unit 36 acquires the detection value commensurate with the inside temperature from the inside temperature sensor 44 and acquires the detection value commensurate with the piping temperature from the heat pipe temperature sensor 42. Subsequently, the control unit 36 generates a first control value A based on the inside temperature and a second control value B based on the piping temperature (S202).

The control unit 36 generates the first control value A based on the difference between the inside temperature detected by the inside temperature sensor 44 and the target temperature of the storage chamber 6 and generates the second control value B based on the difference between the piping temperature detected by the heat pipe temperature sensor 42 and the standard boiling temperature of the refrigerant. By way of one example, the first control value A based on the inside temperature is generated from a difference between the detection value (the value is stored in the control unit 36 in advance) output by the inside temperature sensor 44 when the inside temperature is the user-defined target temperature and the detection value detected by the inside temperature sensor 44 and corresponding to the current inside temperature. The second control value B based on the piping temperature is generated from a difference between the detection value output by the heat pipe temperature sensor 42 when the piping temperature is the standard boiling temperature of the refrigerant and the detection value detected by the heat pipe temperature sensor 42 and corresponding to the current piping temperature. Inside temperature control performed since the detection of the inside temperature until the generation of the first control value A and piping temperature control performed since the detection of the piping temperature until the calculation of the second control value B are, for example, PID control and are performed in parallel with each other. In inside temperature control, the first control value A is set so that the inside temperature is accommodated in a predetermined range with respect to the target temperature. The predetermined range can be set as appropriate based on an experiment by the designer or simulation. In piping temperature control, the second control value B is set so that the piping temperature is not lower than the standard boiling temperature of the refrigerant. As described in embodiment 1, the refrigerant should be selected so that the standard boiling temperature of the refrigerant is lower than the preset value of the inside temperature.

A determination is then made as to whether the first control value A is smaller than the second control value B (S203). When the first control value A is smaller than the second control value B (Y in S203), the driving voltage based on the first control value A is applied to the refrigerator 14 (S204). When the first control value A is equal or larger than the second control value B (N in S203), the driving voltage based on the second control value B is applied to the refrigerator 14 (S205). As a result, the refrigerator 14 is driven by the driving voltage generated based on the smaller of the first control value A and the second control value B (S206).

According to this control, the driving voltage based on one (the smaller) of the control values generated based on the inside temperature control and piping temperature control is applied to the refrigerator 14. In other words, application of the voltage to the refrigerator 14 is continuous. In this way, abrupt change in power supply to the refrigerator 14 is avoided.

Figure 6A:
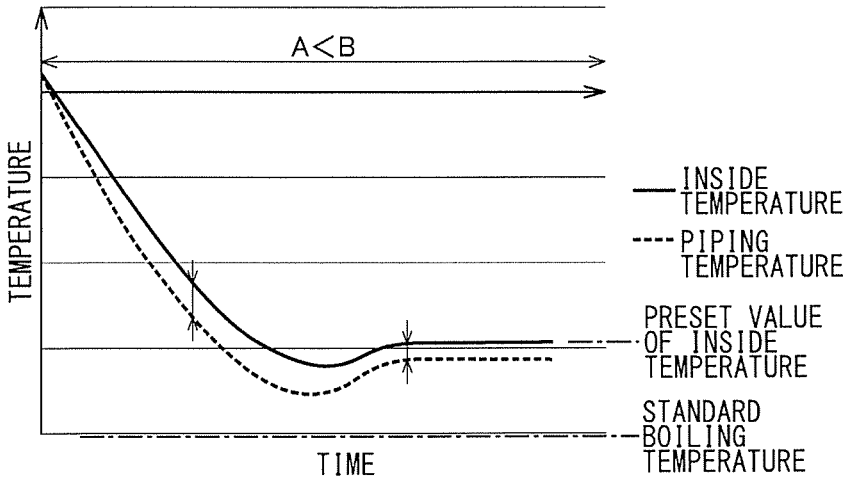
FIGS. 6A and 6B are charts showing an example of transition of the inside temperature and the piping temperature.
Figure 6B:
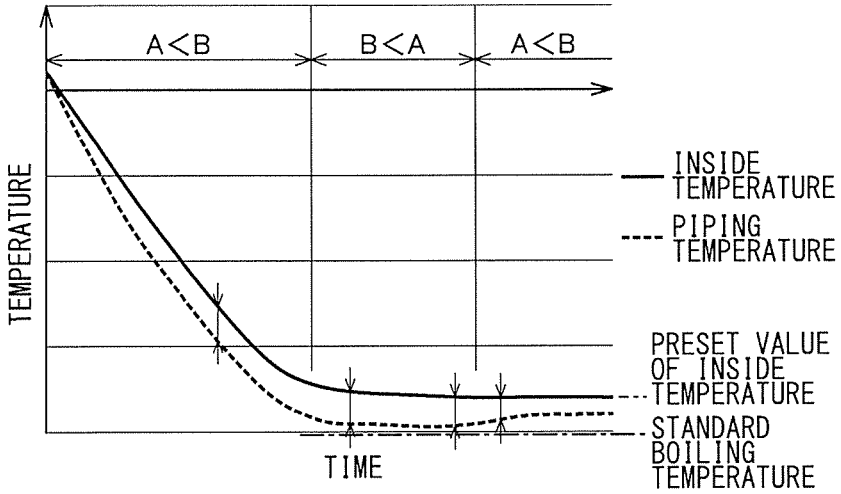

FIGS. 6A and 6B are charts showing an example of transition of the inside temperature and the piping temperature. As shown in FIG. 6A, the first control value A could be always smaller than the second control value B when the preset value of the inside temperature (i.e., the target temperature of the storage chamber 6) is relatively high and is remote from the standard boiling temperature of the refrigerant. In inside temperature control, the inside temperature is controlled so that the inside temperature reaches the preset value promptly. In other words, the integration gain in PID control is high. For this reason, a temporary overshoot of the inside temperature could occur. Further, the temperature difference between the inside temperature and the piping temperature is large while the inside temperature keeps dropping. The inside temperature surpasses the preset value and then approaches the preset value gradually until it is stabilized ultimately, and the first control value A grows smaller in that process. For this reason, the temperature difference between the inside temperature and the piping temperature will be decreased.

When, as shown in FIG. 6B, the preset value of the indoor temperature and the standard boiling temperature are close to each other, on the other hand, the second control value B could be smaller than the first control value A temporarily while the indoor temperature is dropping. In piping temperature control, it is necessary to control the piping temperature not to fall below the standard boiling temperature. For this reason, it is necessary to configure the integration gain in PID control to be low. Therefore, the integration gain in piping temperature control is lower than the integration gain in inside temperature control. For this reason, an overshoot of the inside temperature could be avoided. Further, the first control value A is smaller than the second control value B, and the temperature difference between the inside temperature and the piping temperature is large while the inside temperature keeps dropping. When the inside temperature approaches the preset value, the second control value B becomes smaller than the first control value A at a certain point of time. The control value input to the refrigerator 14 will be the second control value B smaller that the first control value A so that the temperature difference between the inside temperature and the piping temperature will be decreased. In this process, the inside temperature is lowered to approach the piping temperature. When the inside temperature further approaches the preset value subsequently, the first control value A drops gradually until the first control value A becomes smaller than the second control value B at a certain point of time. The temperature difference between the inside temperature and the piping temperature will be decreased further. In this process, the piping temperature is increased to approach the inside temperature.

As described above, the internal pressure of the heat pipe 16 is prevented from being less than the atmospheric pressure according also to the refrigeration device 12 of this embodiment. As a result, entry of ambient air into the heat pipe 16 is inhibited.

Embodiment 3

The refrigeration device according to embodiment 3 differs significantly from the refrigeration device according to embodiments 1, 2 in that it includes a plurality of combinations each including the refrigerator 14, the heat pipe 16, and the heat pipe temperature sensor 42. The features of the refrigeration device according to embodiment 3 that are different from the features of embodiments 1, 2 will be described mainly. Common features will be described briefly, or a description thereof will be omitted.

Figure 7A:
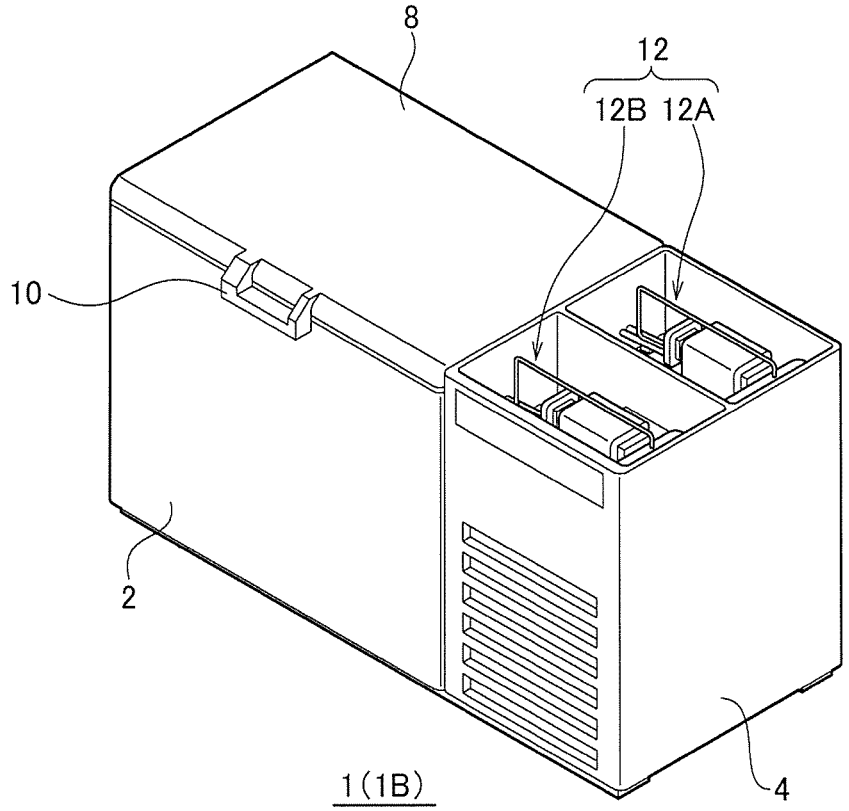
FIG. 7A is a perspective view showing a schematic structure of a low-temperature storage in in which the refrigeration device according to embodiment 3 is installed.
Figure 7B:
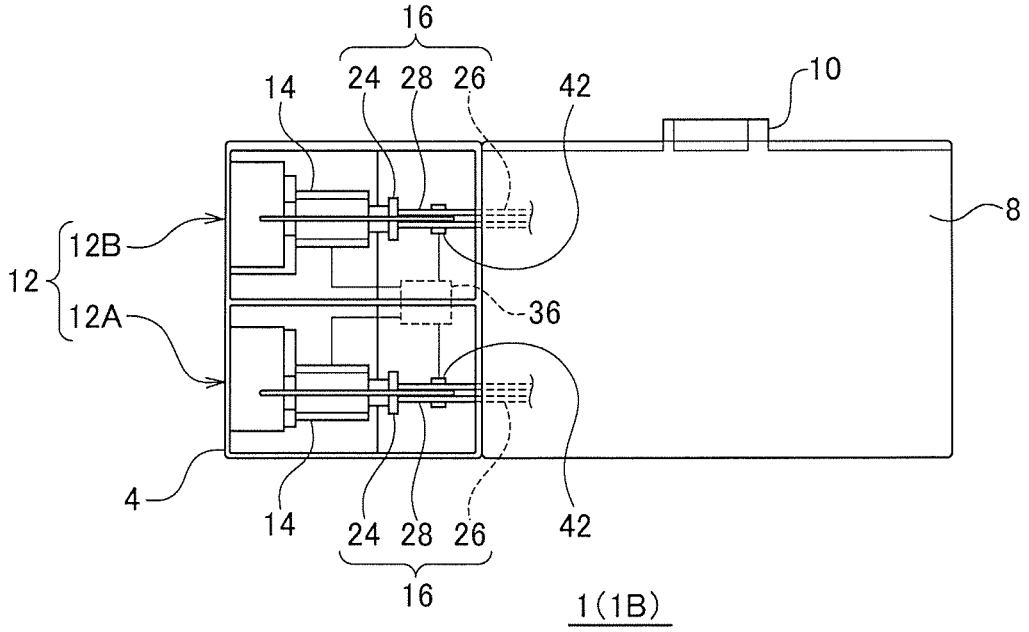
FIG. 7B is a plan view showing a schematic structure of the low-temperature storage.

FIG. 7A is a perspective view showing a schematic structure of a low-temperature storage in which the refrigeration device according to embodiment 3 is installed. FIG. 7B is a plan view showing a schematic structure of the low-temperature storage. The refrigeration device 12 according to this embodiment installed in the low-temperature storage 1 (1B) includes a plurality of combinations each including the refrigerator 14, the heat pipe 16 and the heat pipe temperature sensor 42. By way of one example, a description will be given of the refrigeration device 12 including a first refrigeration unit 12A as the first combination and a second refrigeration unit 12B as the second combination. The number of combinations is not limited to two.

The features of the refrigerator 14, the heat pipe 16, and the heat pipe temperature sensor 42 provided in each of the first refrigeration unit 12A and the second refrigeration unit 12B are identical those of the refrigeration device 12 according to embodiment 1. The refrigerant circuits of the respective refrigeration units are independent from each other. Further, the refrigeration device 12 is provided with the control unit 36 common to the first refrigeration unit 12A and the second refrigeration unit 123. In other words, one control unit 36 controls the refrigerators 14 of the respective refrigeration units. The control unit 36 receives a signal from each of the heat pipe temperature sensor 42 of the first refrigeration unit 12A and the heat pipe temperature sensor 42 of the second refrigeration unit 12B.

Figure 8:
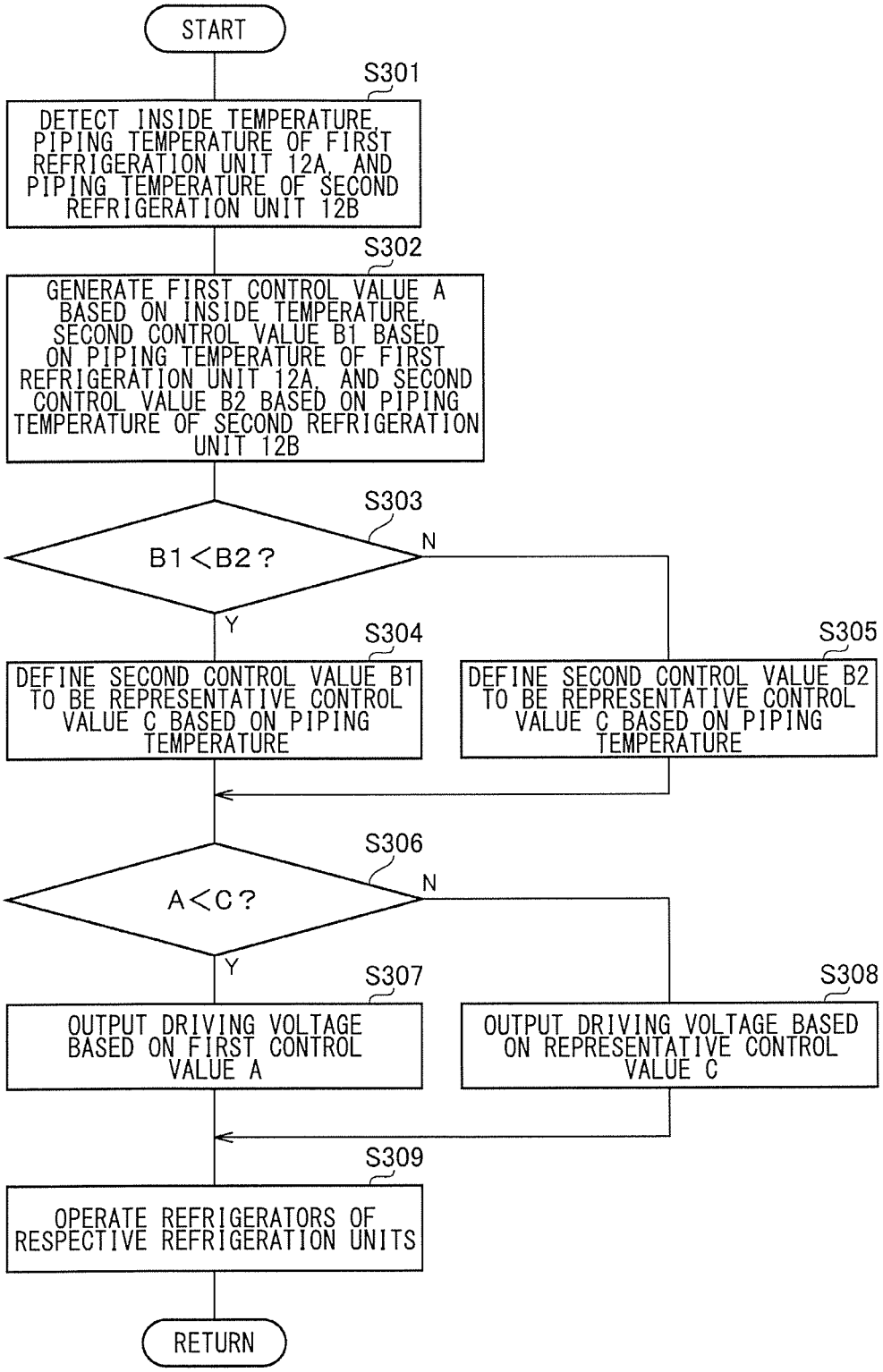
FIG. 8 is a flowchart showing an example of control performed by the refrigeration device according to embodiment 3.

The control unit 36 controls the refrigerators 14 of the first refrigeration unit 12A and the second refrigeration unit 12B based on the common piping temperature. The control unit 36 according to the embodiment controls the driving of the refrigerators 14 based on the lowest of the temperatures detected by the heat pipe temperature sensors 42 of the first refrigeration unit 12A and the second refrigeration unit 12B. FIG. 8 is a flowchart showing an example of control performed by the refrigeration device according to embodiment 3. The flow is is performed by the control unit 36 repeatedly according to a predetermined timing schedule.

As shown in FIG. 8, the inside temperature, the piping temperature of the first refrigeration unit 12A, and the piping temperature of the second refrigeration unit 12B are first detected (S301). The control unit 36 acquires the detection value of the inside temperature from the inside temperature sensor 44 (see FIG. 2). The control unit 36 also acquires the respective detection values of the piping temperature from the heat pipe temperature sensors 42 of the respective refrigeration units. Subsequently, the first control value A based on the inside temperature, the second control value B1 based on the piping temperature of the first refrigeration unit 12A, and the second control value B2 based on the piping temperature of the second refrigeration unit 12B are generated (S302). The method of generating the first control value A is the same as the method of generating the first control value A in embodiment 2. The method of generating the second control value B1 and the second control value B2 is the same as the method of generating the second control value B in embodiment 2.

A determination is then made as to whether the second control value B1 is smaller than the second control value B2 (S303). When the second control value B1 is smaller than the second control value B2 (Y in S303), the second control value B1 is determined to be a representative control value C based on the piping temperature (S304). When the second control value B1 is equal to or larger than the second control value B2 (N in S303), the second control value B2 is determined to be the representative control value C based on the piping temperature (S305).

A determination is then made as to whether the first control value A is smaller than the representative control value C (S306). When the first control value A is smaller than the representative control value C (Y in S306), the driving voltage based on the first control value A is applied to the refrigerators 14 of the respective refrigeration units (S307). When the first control value A is equal to or larger than the representative control value C (N in S306), the driving voltage based on the representative control value C is applied to the refrigerators 14 of the respective refrigeration units (S308). The refrigerators 14 of the respective refrigeration units are driven accordingly (S309).

According to the control, the smaller of the second control value B1 calculated based on the piping temperature of the first refrigeration unit 12A and the second control value B2 calculated based on the piping temperature of the second refrigeration unit 12B is compared with the first control value A calculated based on the inside temperature. This makes it possible to make the output balance in the respective refrigeration units constant, maintaining the internal pressure of the heat pipes 16 of the respective refrigeration units to be equal to or higher than the atmospheric pressure. As a result, the temperature distribution in the storage can be maintained uniform. Further, the internal pressure of the heat pipes 16 in the respective refrigeration units can be maintained to be equal to or higher than the atmospheric pressure more properly.

The driving of the refrigerators 14 in the first refrigeration unit 12A and the second refrigeration unit 12B may be controlled independently. In this case, the second control value B1 is calculated in the first refrigeration unit 12A based on the piping temperature. Further, the second control value B2 is calculated in the second refrigeration unit 12B based on the piping temperature. Further, the first control value A is calculated based on the inside temperature. The first control value A is common to the respective refrigeration units. In the first refrigeration unit 12A, the magnitude of the first control value A and that of the second control value B1 are compared and the driving voltage based on the smaller of the control values is applied to the refrigerator 14. Further, in the second refrigeration unit 12B, the magnitude of the first control value A and that of the second control value B2 are compared and the driving voltage based on the smaller of the control values is applied to the refrigerator 14.

The embodiments of the present disclosure are not limited to those described above and the embodiments may be combined, or various further modifications such as design changes may be made based on the knowledge of a skilled person. The embodiments resulting from such combinations or further modification are also within the scope of the present disclosure. New embodiments created by combining embodiments or modifying the embodiment will provide the combined advantages of the embodiment and the variation.

Optional combinations of the aforementioned constituting elements, and implementations of the invention in the form of methods, apparatuses, and systems may also be practiced as additional modes of the present invention.

What is claimed is:

1. A refrigeration device comprising:

a refrigerator;

a heat pipe that includes a condensation unit connected to the refrigerator in a manner that heat exchange is enabled and adapted to condense a refrigerant, includes an evaporation unit connected to a storage chamber for housing an object that should be stored in a manner that heat exchange is enabled and adapted to evaporate the refrigerant, and includes a piping for circulating the refrigerant between the condensation unit and the evaporation unit;

a heat pipe temperature sensor that detects a temperature of the heat pipe; and a control unit that controls driving of the refrigerator based on a result of detection by the heat pipe temperature sensor, wherein the control unit controls the refrigerator so that the temperature of the heat pipe does not fall below a standard boiling temperature of the refrigerant.

2. The refrigeration device according to claim 1, further comprising:

an inside temperature sensor that detects a temperature of the storage chamber, wherein the control unit controls the driving of the refrigerator based on a result of detection by the heat pipe temperature sensor and the inside temperature sensor, and the control unit controls the refrigerator based on the result of detection by the inside temperature so that the temperature of the storage chamber is within a predetermined range with respect to a predetermined target temperature, when a difference between the temperature of the heat pipe and the standard boiling temperature of the refrigerant is equal to or smaller than a predetermined value, the control unit restricts an output of the refrigerator irrespective of the result of detection by the inside temperature sensor, and when the difference between the temperature of the heat pipe and the standard boiling temperature of the refrigerant exceeds the predetermined value, the control unit resumes controlling the refrigerator based on the result of detection by the inside temperature sensor.

3. The refrigeration device according to claim 2, wherein when the difference between the temperature of the heat pipe and the standard boiling temperature of the refrigerant is equal to or smaller than the predetermined value, the control unit stops driving the refrigerator.

4. The refrigeration device according to claim 1, further comprising:

an inside temperature sensor that detects a temperature of the storage chamber, wherein the control unit controls the driving of the refrigerator based on a result of detection by the heat pipe temperature sensor and the inside temperature sensor, and the control unit generates a first control value based on a difference between the temperature of the storage chamber detected by the inside temperature sensor and a target temperature of the storage chamber, the control unit generates a second control value based on a difference between the temperature of the heat pipe detected by the heat pipe temperature sensor and the standard boiling temperature of the refrigerant, and the control unit controls the refrigerator based on the smaller of the first control value and the second control value.

5. The refrigeration device according to claim 1, wherein the heat pipe temperature sensor detects a temperature of the piping.

6. The refrigeration device according to claim 5, wherein the refrigerator is provided in a machine room provided at a distance from the storage chamber, a portion of the piping is provided in the machine room, and the heat pipe temperature sensor detects a temperature of the portion in the piping.

7. The refrigeration device according to claim 1, the refrigeration device includes a plurality of combinations each including the refrigerator, the heat pipe, and the heat pipe temperature sensor, and the control unit controls the driving of the refrigerators based on the lowest of the temperatures detected by the heat pipe temperature sensors or based on the temperature in the storage chamber.

8. The refrigeration device according to claim 1, wherein the refrigerant has a standard boiling temperature lower than the lowest of a target temperature of the storage chamber that can be set in the refrigerator.

* * * * *